United States Patent [19]

Schober

[11] 4,050,283

[45] Sept. 27, 1977

[54] METHOD AND APPARATUS FOR FORGING BEVEL GEARS

[75] Inventor: Franz Schober, Munich, Germany

[73] Assignee: Bayerisches Leichtmetallwerk Graf Blucher von Wahlstatt KG, Munich, Germany

[21] Appl. No.: 586,216

[22] Filed: June 12, 1975

[30] Foreign Application Priority Data

June 20, 1974 Germany ..... 2429543

[51] Int. Cl.[2] ..... B21D 22/02; B21D 45/00; B21K 1/30

[52] U.S. Cl. ..... 72/344; 29/DIG. 18; 29/159.2; 29/420.5; 72/354; 72/360

[58] Field of Search ..... 29/DIG. 18, DIG. 31, 29/159.2, 420.5; 72/344, 345, 346, 354, 427, 361, 419, 360; 10/11 E; 425/78

[56] References Cited

U.S. PATENT DOCUMENTS

| | | | |
|---|---|---|---|
| 2,964,838 | 12/1960 | Schober | 29/159.2 |
| 3,247,534 | 4/1966 | McClellan | 10/11 E |
| 3,429,172 | 2/1969 | Lierse et al. | 72/344 |
| 3,677,672 | 7/1972 | Harrington | 425/78 |
| 3,813,909 | 6/1974 | Roger | 29/159.2 X |
| 3,832,763 | 9/1974 | Schober | 29/159.2 |
| 3,887,978 | 6/1975 | Dohmann | 29/159.2 |
| 3,910,091 | 10/1975 | Samanta | 29/159.2 X |

FOREIGN PATENT DOCUMENTS

| | | | |
|---|---|---|---|
| 2,101,313 | 7/1972 | Germany | 72/354 |
| 1,030,793 | 5/1966 | United Kingdom | 72/344 |

*Primary Examiner*—E. M. Combs

[57] ABSTRACT

Helical or spiral bevel gears are forged from powdered material in a mold having a stationary die in which a cavity is provided with an interior gear configuration conforming to the desired gear blank to be forged. An ejector rod is movably mounted within the stationary die along its central axis and is provided with means which cause its stroke to have an axial and rotary movement corresponding to the pitch of the teeth on the gear. The front edge of the ejector rod is provided with means forming a key-lock arrangement with the gear blank, thereby simultaneously rotating the gear out of the die on its ejection stroke.

6 Claims, 5 Drawing Figures

Fig.1
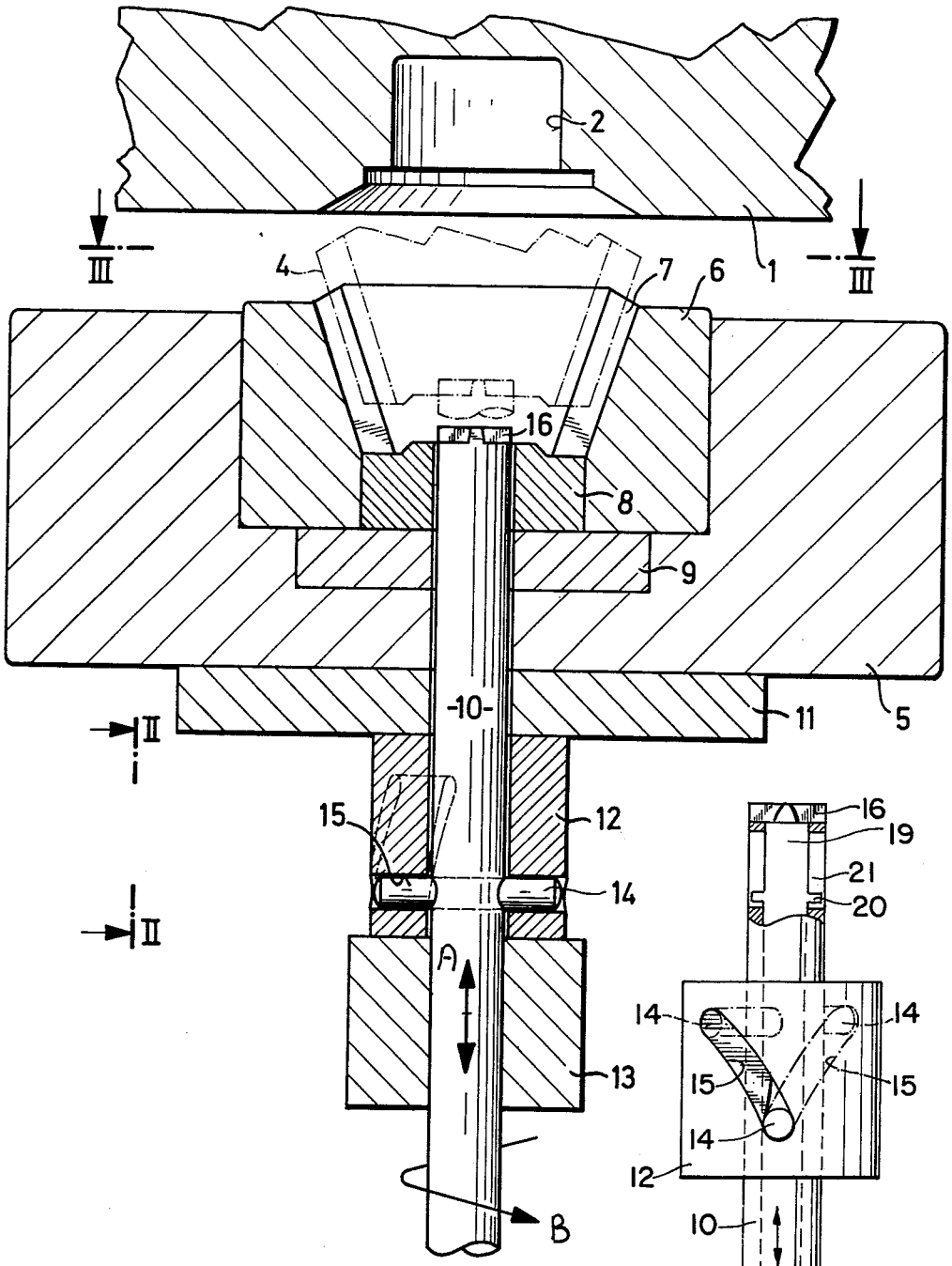
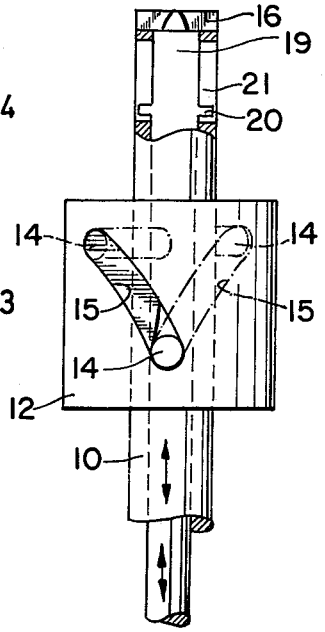
Fig. 5

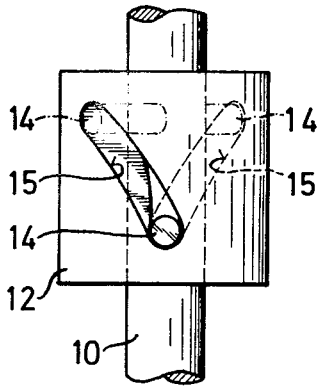
Fig. 2
Fig.3
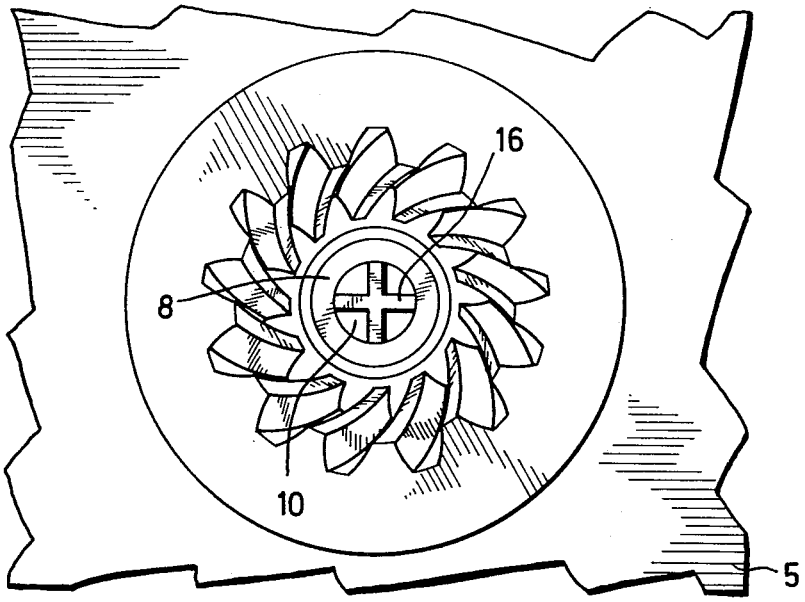
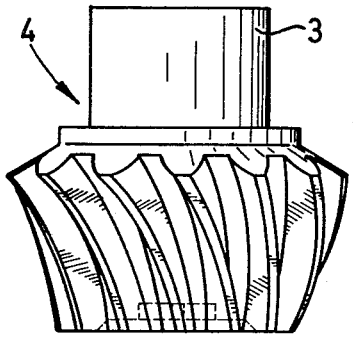
Fig.4

METHOD AND APPARATUS FOR FORGING BEVEL GEARS

BACKGROUND OF THE INVENTION

The present invention relates to a method and apparatus for forging helical or spirally toothed gear members, particularly bevel gears having arcuately generated teeth. The present invention is also applicable to the production of spur gears as well as bevel gears having teeth shapes made, for example, in accordance with the Gleason, Oerlikon, or Klingenberg process systems.

A process for forging straight-toothed bevel gears is known from the German patent pre-publication DT-AS No. 2,144,006. Another process wherein planar gear wheels having spiral teeth are forged or sintered from powdered materials is described in German patent pre-publication DT-AS No. 2,002,684. In this latter publication, a press-mold is employed having a movable ram die which passes through the mold, as an ejector for the ready-forged gear blank. Here, the press-die is provided with a tooth configuration which engages in a corresponding set of teeth formed in the mold. The press-die is rotated during its stroke movement in accordance with the spiral configuration of the engaging toothing. In this device, which serves a purpose different from that of the present application, the lower die has a specific purpose and is adapted only for the formation of specific gear blanks. The lower gear die itself is movable and assumes also the functions of an ejector. As a result, the suitability of the device described in the aforementioned publication is limited to the formation of cylindrical gear wheels with spiral gear faces. Heretofore, the forging of bevel gears has been impossible or limited only to planar gear wheels having hardly noticeable curvature of the teeth, since it is only in these cases in which ejection of the die is possible within the limitation set by the taper of the gear blank. On the other hand, bevel gears having a more marked setting, i.e., with a less steep central pitch of their teeth, could not be forged in a press die, due to the impossibility of removing the finished forged blank from the die.

It is an object of the present invention to provide a method and apparatus for simplifying the forging process of bevelled gears having helical or spiral toothed faces, enabling the large scale production of such gears, at least for those forms of gears having teeth with a fairly constant pitch.

It is a further object of the present invention to provide a method and apparatus for forming helical and spiral tooth gears which overcomes the disadvantages and defects of the prior art and which enables the production of a wide range of spiral or helical bevels.

It is a further object of the present invention to provide simple forging apparatus for the formation of bevelled gears.

The foregoing objects, other objects, and numerous advantages of the present invention are set forth in the following disclosure and will be clearly obvious therefrom.

SUMMARY OF THE INVENTION

According to the present invention, helical or spirally bevelled gears are pressed forged of powdered material in a mold having a stationary die whose cavity is provided with an internal gear configuration conforming to the desired gear to be formed. An ejector rod is movably mounted along the central axis of the die and is provided with means which cause its ejection stroke to have an axial and rotary movement resulting in a vector corresponding to the pitch of the teeth on the gear. The front end of the ejection rod is provided with means forming a key-lock arrangement with the gear blank being formed which thereby results in a turning of the gear.

The apparatus according to the present invention, makes use of otherwise conventional press or die components and is particularly advantageous in using a mold in which the lower die is stationary and is itself normally provided with an ejector rod or similar stripping mechanism. Preferably, the compound movement of the stripper is provided by supporting the ejector rod in a bushing and by providing the ejector rod with laterally extending radially directed pins which are located in an arcuate groove formed in the bushing. The arcuate groove, in relation to the axial direction of the ejector rod is inclined at an angle corresponding to the pitch of the teeth on the bevelled gear. As a result, a rotary movement placed on the ejector rod causes the rod to move in an axial direction compounded with rotary direction which actually corresponds to the pitch of the teeth. During the stroke movement of the ejector rod, the ejector is thus subjected only to a positive control, by mechanical means so that it will always be rotated at an angular speed superimposed on the axial speed in such a way that the combined vector movement will always correspond to the mean pitch of the teeth. Substitution of the bushing with a slot having a different curve can easily be made to conform the apparatus to differently shaped gear structures.

With the foregoing apparatus, it will be apparent that a large variety of bevelled gears having different helical and spiral shapes, can be forged on a conventional die apparatus easily, simply and economically, without the use of complicated breakaway die structures, and without any significant damage to the gear facings on the ejection from the die.

Full details of the present invention are set forth in the following description, and are shown in the accompanying drawings.

BRIEF DESCRIPTION OF THE DRAWINGS

In the drawings:

FIG. 1 is a vertical sectional view taken through a diametral plane of the upper and lower dies of a forging press, showing the ejector rod located therein, FIG. 2 is a partial view of the apparatus in accordance with FIG. 1, showing the ejector rod and support bushing, taken in the direction of arrow II-II, FIG. 3 is a partial plan view of the lower die taken in the direction of the arrows III-III, FIG. 4 is an elevational view of a completed forged bevelled gear, and FIG. 5 is a view similar to FIG. 2 showing a modified ejector rod and support bushing.

DESCRIPTION OF THE INVENTION

The apparatus shown in FIG. 1, to which the present invention has been applied, is generally representative of press dies for the formation of bevelled gears. The apparatus comprises an upper die 1 in which is formed a cavity 2 having a shape conforming to boss 3 of a desired bevelled gear 4, seen in greater detail in FIG. 4. The upper die 1 is mounted to the ram member and is movable toward and away from a lower die 5 which is generally held stationary. The lower die 5 is provided with a barrel or mold 6 which has formed on its inner surface inwardly directed teeth 7, conforming in negative configuration to the shape and curvature of the teeth on bevelled gear 4, desired, as shown in FIG. 4. The floor 8 or bottom of the mold barrel rests on a base 9 set within the die 5. The mold 6 is keyed within the die 5 so as to be nonrotatable therewith but is capable of being removed and replaced with similar barrels.

Suspended along the central axis of the mold 6 and passing through the center of the bottom 8, the base 9, and the die 5, is an ejector rod 10 comprising a cylindrical solid bolt. The ejector rod 10 also passes through a shim 11 set below the die 5 and forming a support therefor and through a bushing 12 and a base block 13. The bushing 12 is freely mounted about the ejector rod 10 and is retained against movement both rotationally and axially by the base block 13 and by suitable fastening means attached to the base block.

A pin 14, having a length substantially greater than that of the diameter of the ejector rod 10 is set within a transverse hole formed in the ejector rod 10 within the confines of the bushing 12. The laterally projecting ends of the pin 14 extend, as seen in FIG. 2, within a pair of slots 15 having a radial and an arcuately axial extending portion diametrically opposed on either side of the central axis of the bushing 12. The slots 15 have a curvature which, in relation to the axial direction of the bushing 12, is inclined at an angle corresponding to the mean pitch of the teeth 7 in the mold 6. A rotary driving force placed on the ejector rod 10 will result in a axial movement of the ejector rod 10, as shown by the double arrow A-A, which when superimposed thereon, produces a helical vector indicated by the arrow B, which corresponds directly to the pitch of the teeth 7. Preferably, the pin 14 is set loosely within the ejector rod 10 so that it can be easily removed through the radial portions of the slot 15 and will easily roll within the arcuate portion of the slot 15 during movement of the ejector 10. The radial portions of the slot 15 also serve to act as a support for the ejector rod 10 suspending it below the cavity 6 of the lower die so that its upper face is in proper position with respect to the floor 8 of the cavity. The pin 14 and the bushing 12 being made of such material as will, of course, withstand the forces of the forging operation.

At the upper end of the ejector rod 10 there is formed a cruxi-form projection 16 which extends within the cavity of the mold 6 so that during the forging operation the bevelled gear itself is formed with a corresponding groove in the gear. As a result, the forged gear is formed with a key-way mating with cross-shaped projections 16, so that once the forging has been completed and the ejector rod 10 is activated into its upward stroke, the forged gear, being keyed to the end of the rod, undergoes a turning or helical movement due to the vector forces created by the interaction of the pin 14 in the slot 15, so that the gear 4 is twisted out of the mold 6 in corresponding to the curvature of the teeth 7. As a result, the gear 4 is ejected without any damage or wear on the teeth, irrespective of the curvature of the teeth. As seen in FIG. 1, the ejected gear is shown in the dotted-phantom lines.

Because of the removable mountability of the bushing 12, and the barrel forming the mold 6, various shaped bevelled gears can be formed on the same forging press. Substitute bushings and molds having conforming pitches in their teeth 7 and the slots 15 can be easily made and the changeover will be both simple and economical. The preferred embodiment as shown in FIGS. 1 through 4 has the particular advantage that it can be easily adapted to different pitches of teeth, as described.

A further modification of the device is possible as shown in FIG. 5 by providing the ejector rod 10 as a hollow cylinder in which is located an auxiliary ejector 19 movable axially therein. The auxiliary ejector 19 may be activated so as to be movable upwardly simultaneously and in conjunction with the rod, as by providing a collar 20 on the auxiliary rod and a slot 21 in the ejector rod, but may also be moved independently thereof, so that on the retracting or downward stroke of the ejector rod 10, the auxiliary ejector 19 can be moved upwardly so as to protrude into the cavity of the mold 6 thereby holding the gear 4 out of the cavity and preventing it from falling back into the cavity before the operator has a chance to remove it. The upper or frontal ends of both the rod and the auxiliary ejector, will have corresponding and cooperating projections so as to form the appropriate keying means producing the rotational movement on the gear itself.

Various other changes and embodiments can be made, as will be obvious to those skilled in the present art. It is, therefore, intended that the present disclosure be taken as illustrative of the invention and not as a limiting of its scope.

What is claimed is:

1. Apparatus for forging helical-toothed or spiral-toothed gear elements comprising a mold having an axially movable die and a stationary die, said stationary die having a peripheral wall and a bottom wall of an internal configuration for forming the teeth of said gear elements, an ejector pin mounted to extend freely through the bottom wall of said stationary die along the central axis thereof, the front face of said ejector pin being provided with means for forming a cooperating keying means with the gear being formed and means for supporting said ejector pin in fixed position during formation of said gear element and for axially and rotationally moving said ejector into said die on completion thereof, said means for moving said ejector pin including means for limiting said movement to a vector corresponding to the pitch of the teeth formed on said gear, thereby simultaneously rotating and ejecting said gear from the stationary die.

2. The apparatus, according to claim 1, wherein said ejector is suspended below said lower die and is supported in its lower position.

3. The apparatus, according to claim 2, wherein said ejector is supported within a cylindrical bushing and is provided with radially extending projections, said bushing being provided with an arcuate slot receiving said projections corresponding to the pitch of the teeth of the gear to be forged.

4. The apparatus, according to claim 3, wherein said radial projections are formed by a pin freely insertable in a transverse hole formed in said ejector, the ends of said pins being removably mounted in said passage.

5. The apparatus, according to claim 1, wherein said ejector comprises a hollow cylindrical rod, an auxiliary ejector located within the bore of said rod, said auxiliary ejector being movable axially within said rod in relation to said rod so as to protrude during the retracting movement of the first ejector.

6. In the method for forging helical-toothed or spiral-toothed gear elements in a die press having a movable die and a stationary die with peripheral walls and a bottom wall, said stationary die formed with an internal configuration conforming to the teeth of a gear element to be forged, comprising the steps of suspending an ejector within said die along its central axis and below its floor, providing on the front face of said ejector means for forming a cooperating key and keyway with the gear to be forged, maintaining said ejector in a fixed position so that the front face forms a portion of said stationary die and axially and rotationally moving said ejector into said die in a vector corresponding to the pitch of the teeth to be formed on said gear after completion of the forging to thereafter cause said cooperating key and keyway to rotate and remove said gear, from said stationary die.

* * * * *